US005582121A

United States Patent [19]

Nanjo et al.

[11] Patent Number: 5,582,121

[45] Date of Patent: Dec. 10, 1996

[54] APPARATUS FOR SEWING A THREAD CHAIN IN A CHAIN STITCH SEWING MACHINE

[75] Inventors: Tetsuji Nanjo; Masamichi Suzawa, both of Osaka, Japan

[73] Assignee: Pegasus Sewing Machine Mfg. Co., Ltd., Osaka, Japan

[21] Appl. No.: 332,386

[22] Filed: Oct. 31, 1994

[30] Foreign Application Priority Data

Nov. 16, 1993 [JP] Japan ..... 5-286422

[51] Int. Cl.[6] ..... D05B 65/00

[52] U.S. Cl. ..... 112/288; 112/DIG. 2

[58] Field of Search ..... 112/288, 287, 112/300, DIG. 1, DIG. 3, 163, 197, 199, 200, 201, 202

[56] References Cited

U.S. PATENT DOCUMENTS 5,159,889 11/1992 Price et al. ..... 112/288 X
5,203,270 4/1993 Price et al. ..... 112/288 X

*Primary Examiner*—Peter Nerbun
*Attorney, Agent, or Firm*—Jones, Tullar & Cooper, P.C.

[57] ABSTRACT

An apparatus for a chain stitch sewing machine, for automatically shifting a thread chain from the stitching area to its opposite side and holding it there, and for stitching the thread chain neatly onto the initial seam on a fabric supplied successively to the sewing machine. A nozzle for blowing the thread chain forwardly is provided behind a presser foot of the sewing machine. In front of the needle hole of the presser foot, an opening vertically penetrates the presser foot located backwardly of a double chain stitch needle relative to the direction of movement of the material for guiding the thread chain, and a groove is formed on the lower surface of the presser foot from the hole toward the opening. A thread chain suction tube is provided above the opening. The thread chain is precisely aligned on the sewing line by the groove.

2 Claims, 8 Drawing Sheets

APPARATUS FOR SEWING A THREAD CHAIN IN A CHAIN STITCH SEWING MACHINE

BACKGROUND OF THE INVENTION

The present invention relates to a sewing machine including a presser foot for pressing a fabric on a feed dog which operates through slots on a needle plate. The sewing machine forms a chain stitch by collaboration with a needle reciprocating vertically (penetrating up and down) through the presser foot and needle plate and a looper which traverses on makes elliptical path laterally and longitudinally beneath the needle plate. More particularly, in a sewing machine of this kind, the present invention relates to an apparatus for cutting off a thread chain formed consecutively with the tail end of a seam on a fabric, and for sewing the cut thread chain connected to the needle into the seam of the initial end on the fabric to be sewn next, thereby preventing looseness (ravel) of the thread at the beginning end of sewing.

In a lock stitch sewing machine, to prevent ravel of thread from the initial end or tail end of a seam, "turn sewing (reverse stitch)" is done, but in a chain stitch sewing machine such as an overedge sewing machine, since the seam cannot be formed while moving back the fabric, generally, the thread chain formed consecutively with the tail end of sewing on the fabric is held in front of the sewing area, and the thread chain is sewn into the overedge seam together with the start of sewing of the next fabric. As disclosed, for example, in Japanese Laid-open Patent No. 54-16257 (U.S. Pat. No. 4,175,500), in a safety seam sewing machine for forming a double chain stitch inside the fabric along the overedge seam, the thread chains of the overedge seam and the double chain stitch are both held in front of the sewing area before the start of sewing, and they are sewn into the overedge seam to be formed in the fabric together with the start of sewing.

In such double chain stitch sewing machines, incidentally, the thread chain is pulled and turned to the front of the sewing area by a manual operation, and its end is held by a gripping tool called a gripper. It, therefore, requires a complicated job to treat a thread chain, which is likely to lower sewing efficiency. In a sewing machine which has an overedge needle located backwardly of a double chain stitch needle relative to the direction of movement of the material, one thread chain of an overedge seam or a double chain stitch will loosen and therefore it may be difficult to sew the loosened chain into the overedge seam.

SUMMARY OF THE INVENTION

It is hence a primary object of the present invention to provide an apparatus for sewing a thread chain in a chain stitch sewing machine, capable of automatically shifting and holding the thread chain in front of the sewing area, and then sewing it neatly into the seam.

The apparatus of the present invention includes a rear cutter for operating across a fabric feed direction behind a presser foot of a sewing machine, and an air blow tube having forwardly directed outlet. The rear cutter cuts the thread chain formed successively to the tail end of a seam on the fabric, and the air blow tube brings the thread chain, cut off by the rear cutter and connecting to the needle, to the front side by the air.

A feature of the presser foot of the sewing machine is that an opening for guiding the thread chain penetrates vertically in front of the needle hole, and that a groove is formed along the sewing line toward the opening from the needle hole in the bottom of the presser foot.

In the apparatus of the present invention, moreover, a thread chain suction tube is provided above the opening for guiding the thread chain.

When the presser foot of the apparatus is lifted above the needle plate, the thread chain is guided to the thread chain suction tube through the groove and the opening by the air blown out from the air blow tube.

The thread chain suction tube is provided with thread chain holding means. Preferably, a leaf spring driven by a pneumatic cylinder should be provided in the thread chain holding means, and the front end portion of the thread chain sucked into the thread chain suction tube is held between the leaf spring and the inner wall of the thread chain suction tube.

Simultaneously, the thread chain near the needle and beneath the presser foot is positioned above the seam line on a fabric which is being restrained by the groove, and keeps its position until the next fabric is supplied for sewing. After inserting the next fabric between the presser foot and needle plate, and when the presser foot is lowered to start the sewing machine, the thread chain being held as mentioned above is guided by the groove to advance along the seam line, and is neatly sewn into the chain stitch formed on the fabric, thereby preventing ravel of thread at the beginning end of sewing.

The thread chain holding means having a leaf spring to be pressed to the inner wall of the thread chain suction tube by air pressure can hold the thread chain relatively flexibly and securely by the elastic force of the leaf spring, and the thread chain can be securely sewn into the seam by drawing it smoothly out of the thread chain holding means together with the sewing of the next fabric. The thread chain holding means may comprise a structure other than a leaf spring and pneumatic cylinder to achieve the object of the present invention. For example the suction action of the thread chain suction tube may be utilized as the thread chain holding means.

Other and further objects, features and advantages of the present invention will appear more fully from the following description. It is to be expressly understood, however, that the drawings are for the purpose of illustration only and are not intended as a definition of the limits of the present invention.

DESCRIPTION OF THE PREFERRED EMBODIMENT

Figure 1:
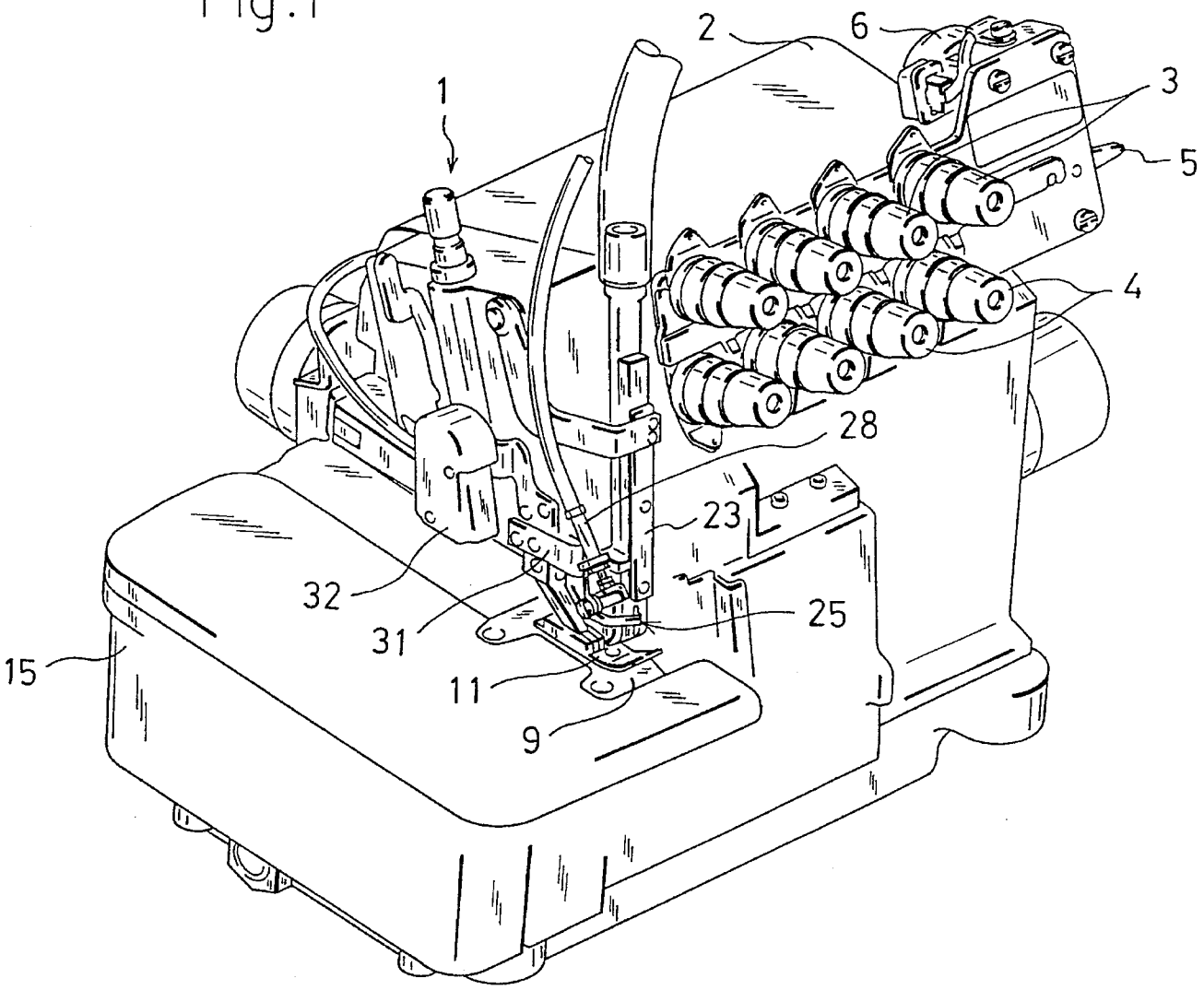
FIG. 1 is a perspective view showing a general appearance of a safety seam sewing machine having a thread chain sewing apparatus according to an embodiment of the present invention.

In the drawings, reference numeral 3 shows a tension regulator row for sewing and 4 shows a tension regulator row for forming a thread chain. These tension regulator rows 3, 4 are arranged in upper and lower rows in front of a sewing machine arm 2. These tension regulators in either row are and designed to be changed over into an active state by manual operation through a lever 5 or by automatic operation through a solenoid 6.

This safety seam sewing machine 1, like an ordinary safety seam sewing machine, has a needle 7 for overedge seaming, a needle 8 for double chain stitching (FIG. 3), a known looper (not shown) which lateral executes both and longitudinal elliptical movement and as being disposed beneath a needle plate 9 in correspondence with the needles 7, 8, feed dogs 12 operating to move up and down on the needle plate 9 through slits 10 formed on the needle plate 9, a presser foot 11 for pressing a fabric W to the feed dogs 12 to feed the fabric W in the direction of arrow X in cooperation with the feed dogs 12, and a pair of upper and lower cutters 13, 14 for trimming the edge of the fabric W prior to overedging, thereby forming a seam E of overedge and a seam D of double chain stitch inside the seam E with the needles 7, 8 and the corresponding loopers.

Figure 3:
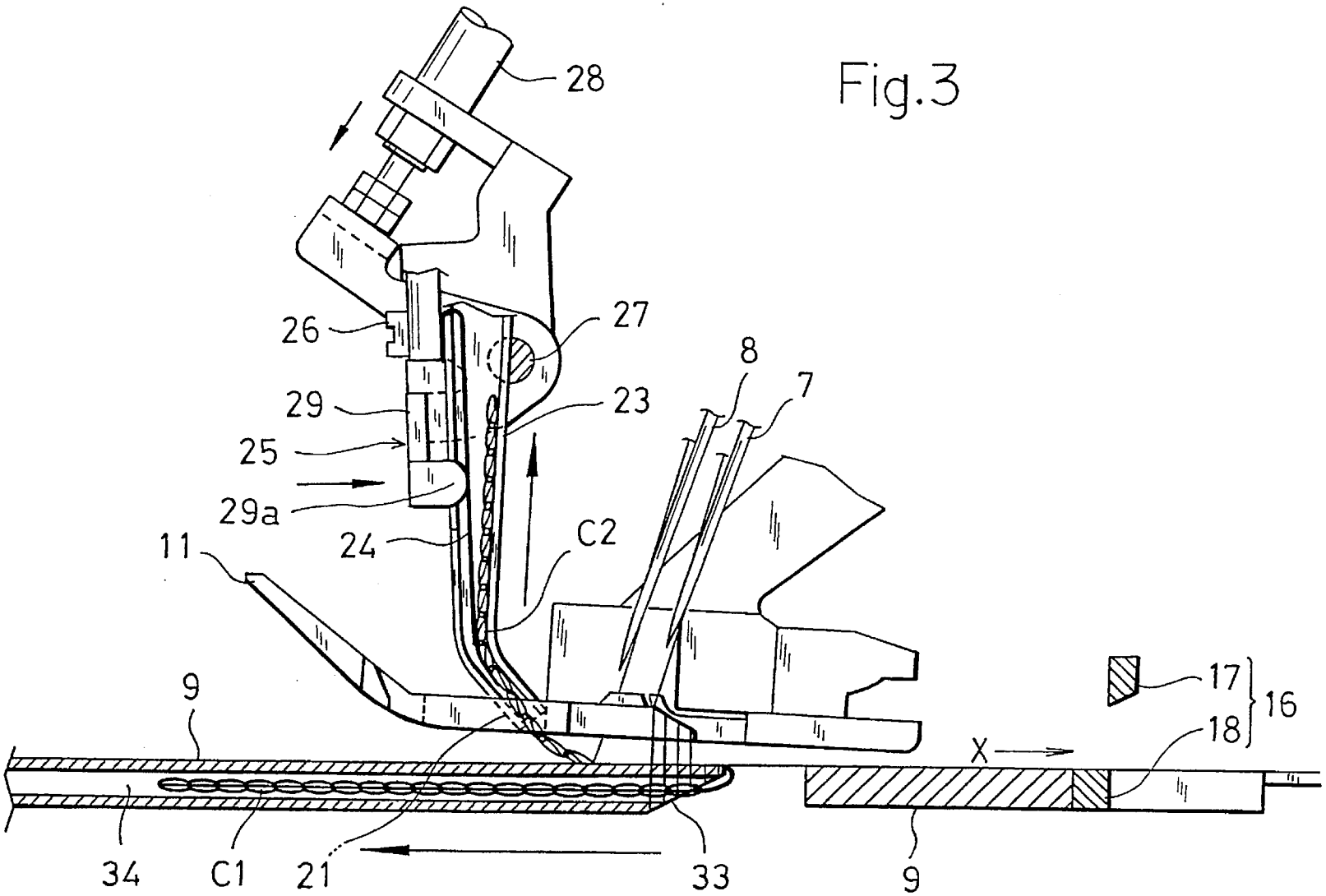
FIG. 3 is an enlarged sectional view showing the essential parts of the apparatus of FIG. 1.

Reference numeral 15 shows a fabric supporting bed. Behind the needle plate 9 and presser foot 11 on the bed 15, there is a rear cutter 16 for cutting thread chains C, that is, a thread chain C1 for an overedge seam and a thread chain C2 for a double chain stitch seam. This rear cutter 16 consists of, as shown in FIG. 3, an upper blade 17 orthogonal to the fabric feed direction X, and a lower blade 18 fixed on the same plane as the needle plate 9 confronting the upper blade 17. Cutting action is effected by moving the upper blade 17 up and down relative to the lower blade 18 through a drive member (not shown in the drawing).

Figure 2:
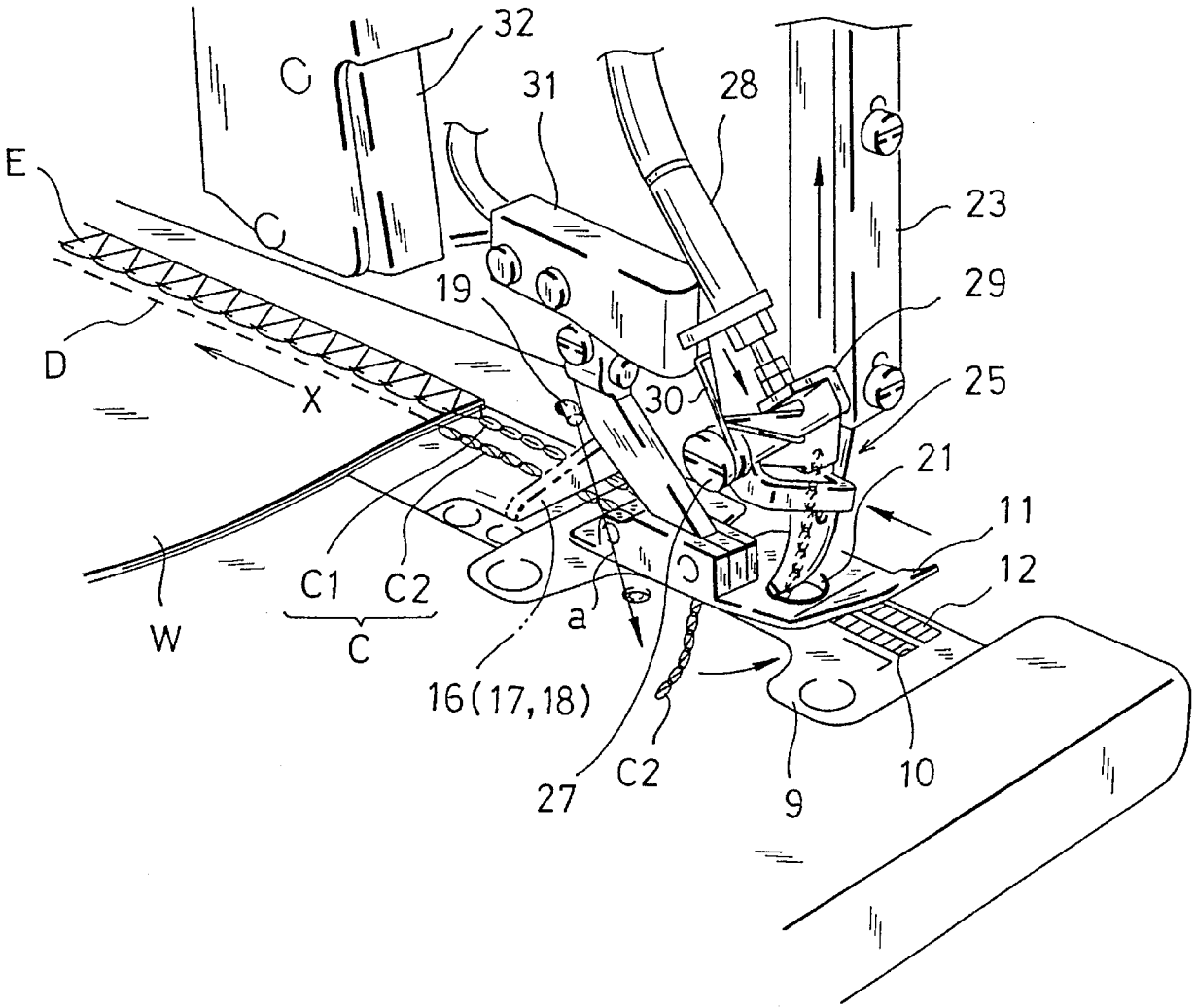
FIG. 2 is an enlarged perspective view showing essential parts of the apparatus of FIG. 1.
Figure 4:
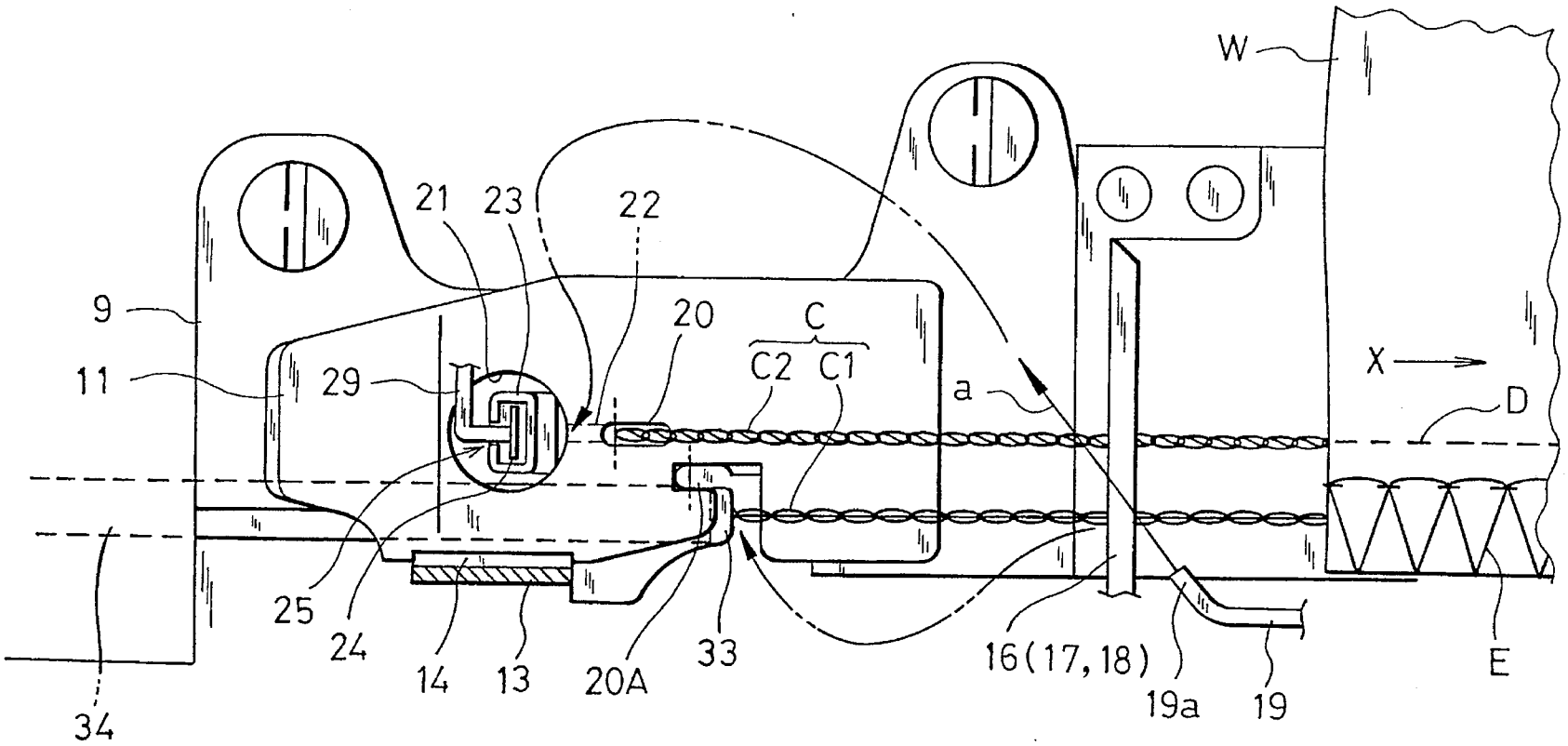
FIG. 4 is an enlarged plan view showing the essential parts of the apparatus of FIG. 1.
Figure 5:
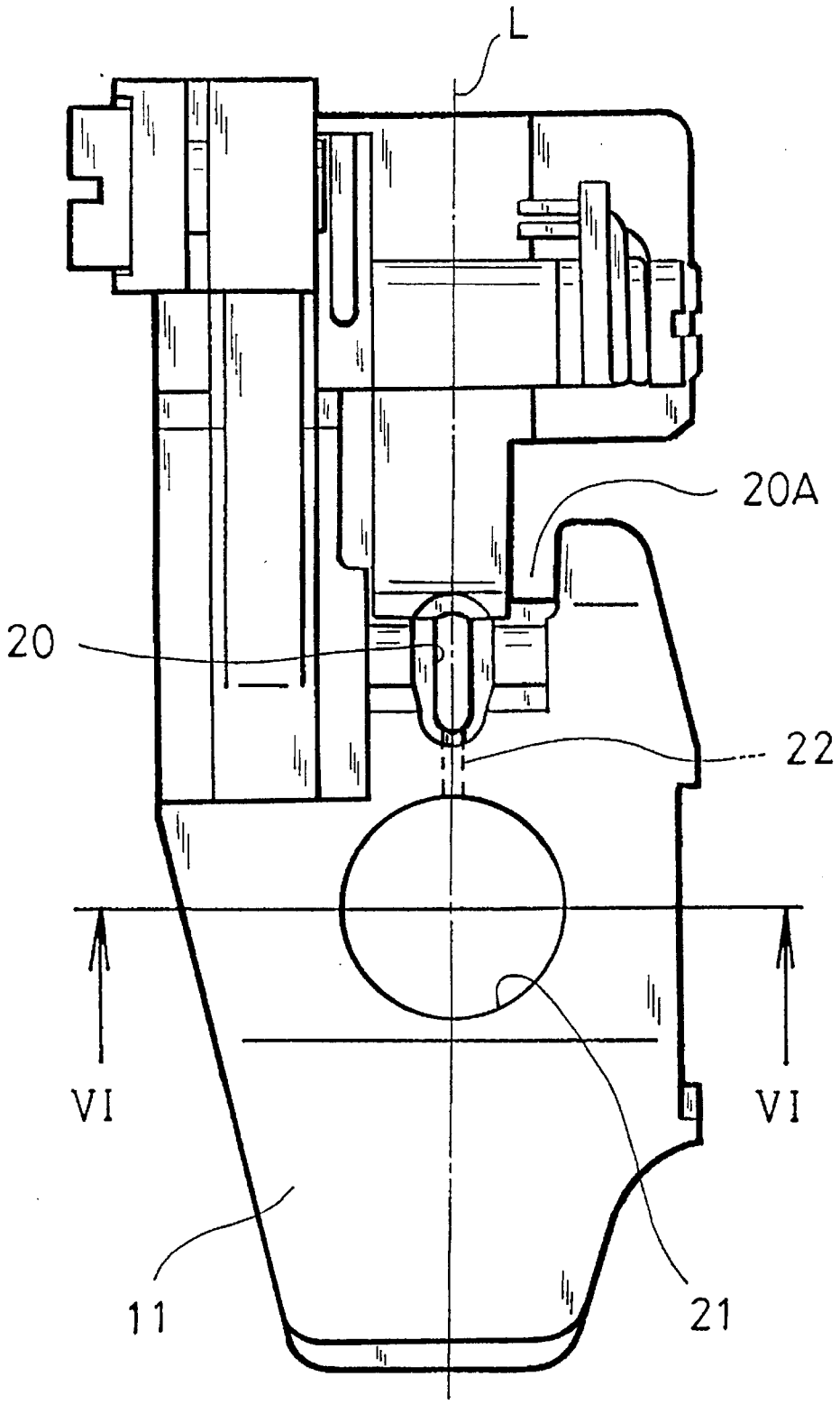
FIG. 5 is an enlarged plan view showing a presser foot which is one of essential parts shown in FIG. 1.
Figure 6:
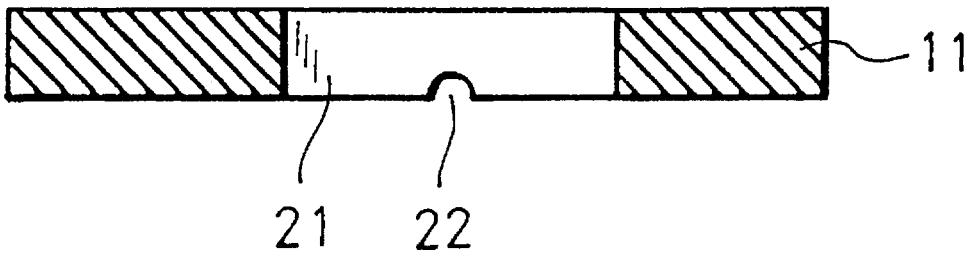
FIG. 6 is a sectional view along line VI—VI in FIG. 5.

Reference numeral 19 indicates a thread chain blow-back tube disposed behind the rear cutter 16, and its front end 19*a* is opened obliquely to the front as shown in FIG. 2 and FIG. 4. By spouting air supplied from a compressed air source (compressor) 43 shown in FIG. 7 in the direction of arrow a, the thread chain C2 after being cut by the needle 8 is blown back forwardly. The presser foot 11 is provided with an opening 21 penetrating vertically at the front side of a needle hole 20 for the needle 8 as shown in FIG. 5 and FIG. 6. On the lower surface of the presser foot 11 a groove 22 is formed along a sewing line L toward the opening 21 from the needle hole 20 for the needle 8. The sewing line L refers to the line in the fabric running direction, passing the position of vertical motion of the needle 8. Reference numeral 20A shows a groove for the needle 7 for overedge seaming.

Above the opening 21, a thread chain suction tube 23 is disposed, and in this thread chain suction tube 23, as most clearly shown in FIG. 3, a thread chain gripping means 25 having a pneumatically operated leaf spring 24 is provided. The leaf spring 24 has its upper end fixed to the thread chain suction tube 23 by a screw 26. An action end 29*a* of a rocker arm 29 which is turned by an air cylinder 28 about a horizontal pin 27 supported on the thread chain suction tube 23 presses the leaf spring 24 toward the inner wall of the thread chain suction tube 23. The thread chain C2 sucked in the tube 23 is held between the leaf spring 24 and the inner wall.

When the air cylinder 28 contracts, the rocker arm 29 is turned reversely about the horizontal pin 27 by a torsion coil spring 30, and the pressure toward the inner wall at the lower end of the leaf spring 24 is released.

Furthermore, in this safety seam sewing machine 1, a fabric detection sensor 31 is provided above the presser foot 11, and a manual switch 32 for action of the rear cutter 16 is provided behind the fabric detection sensor 31. In addition, a stitch number counter, a pneumatic device for thread chain blow-back tube 19, and its control device are provided, but are not shown in the drawings. In this embodiment, as shown in FIG. 3 and FIG. 4, a tongue 33 for supporting the thread chain C1 of an overedge seam on the needle plate 9 has a tubular hollow part forwardly from the top end, and this tubular hollow part is formed to be a suction tube 34 for the thread chain C1.

Figure 7:
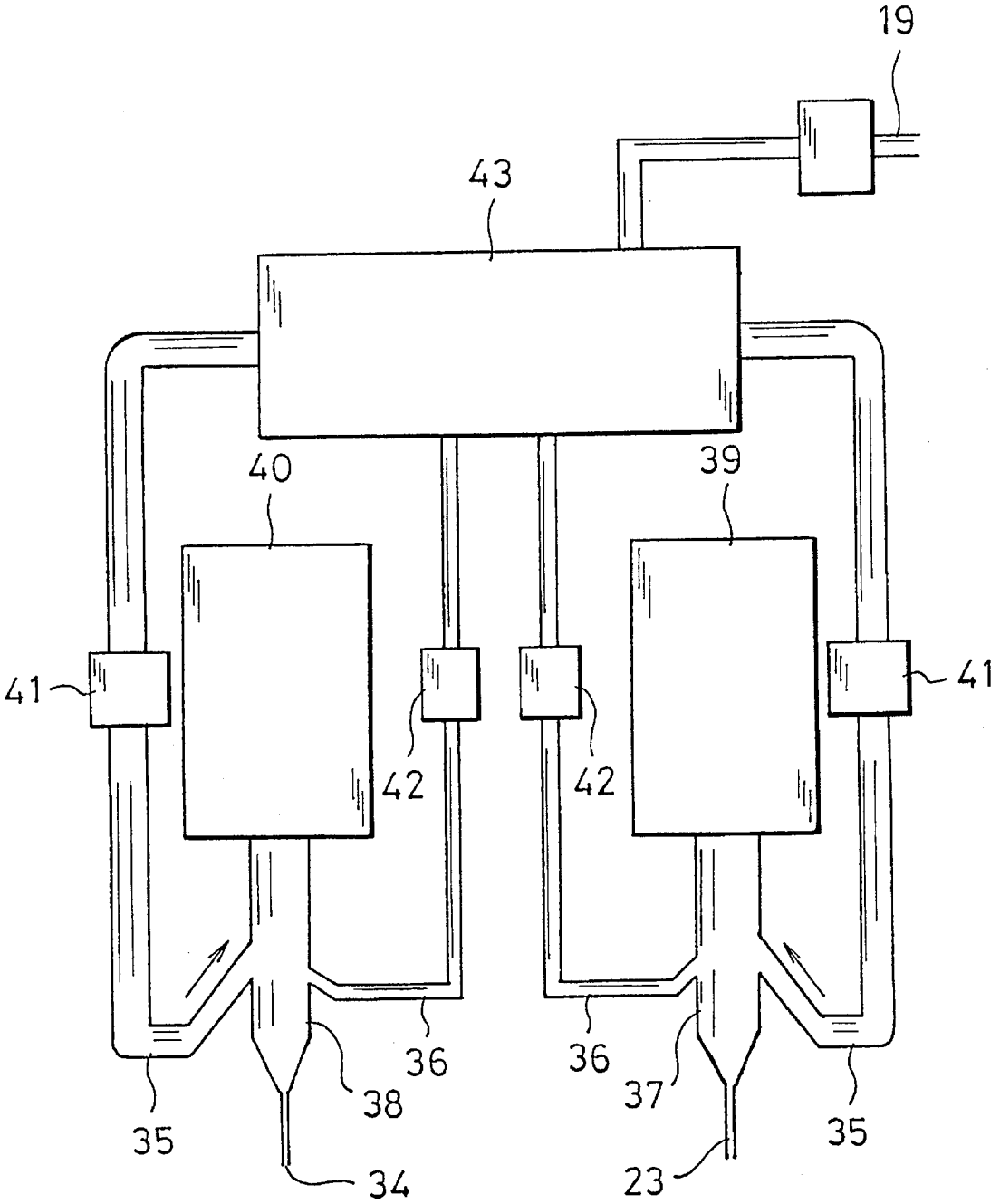
FIG. 7 is a schematic piping diagram of a pneumatic operating part in the embodiment shown in FIG. 1.

As shown in FIG. 7, the thread chain suction tubes 23 and 34 are connected to dust collecting chambers 39, 40 through Venturi tubes 37, 38 of large aperture provided with thick and thin branch tubes 35, 36, respectively. The thick and thin branch tubes 35, 36 are connected to a compressor 43 through control valves 41, 41 and flow regulating valves 42, 42.

Next is explained the sewing action by the safety seam sewing machine 1 in this embodiment.

As shown in FIG. 2, at the end of sewing, when the fabric detection sensor 31 detects the tail end of the fabric W, the stitch number counter is actuated, and after thread chains C (C1, C2) are formed by a preset number of stitches successively to the tail end seam of the fabric W, the sewing machine 1 stops. In succession, the upper blade 17 of the rear cutter 16 is actuated to cut off the thread chain C1 for the overedge seam and the thread chain C2 for the double chain stitch formed consecutively with the rear end of the fabric W.

Consequently, the presser foot 11 is raised, and high pressure air is blown out from the front end 19*a* of the thread chain blow-back tube 19 in the direction of arrow a. At the same time the control valve 41 is opened to inject air into the thread chain suction tubes 23 and 34, and then, as shown in FIG. 3 and FIG. 4, the thread chain C1 a for the overedge seam, after being cut off is sucked into the tube 34 from the top of tongue 33 of the needle plate 9, while the thread chain C2 for the double chain stitch is sucked up into the tube 23 through the groove 22 and the opening 21. Thereafter, the air cylinder 28 is expanded to turn the rocker arm 29, and the leaf spring 24 of the thread chain gripping means 25 is pressed, then the thread chain C2 for the double chain stitch beneath the presser foot 11 consecutive to the needle 8 is placed along the groove 22 positioned on the sewing line L, and the free end of the thread chain C2 is held within the tube 23, thereby waiting for sewing of the next fabric.

Figure 8:
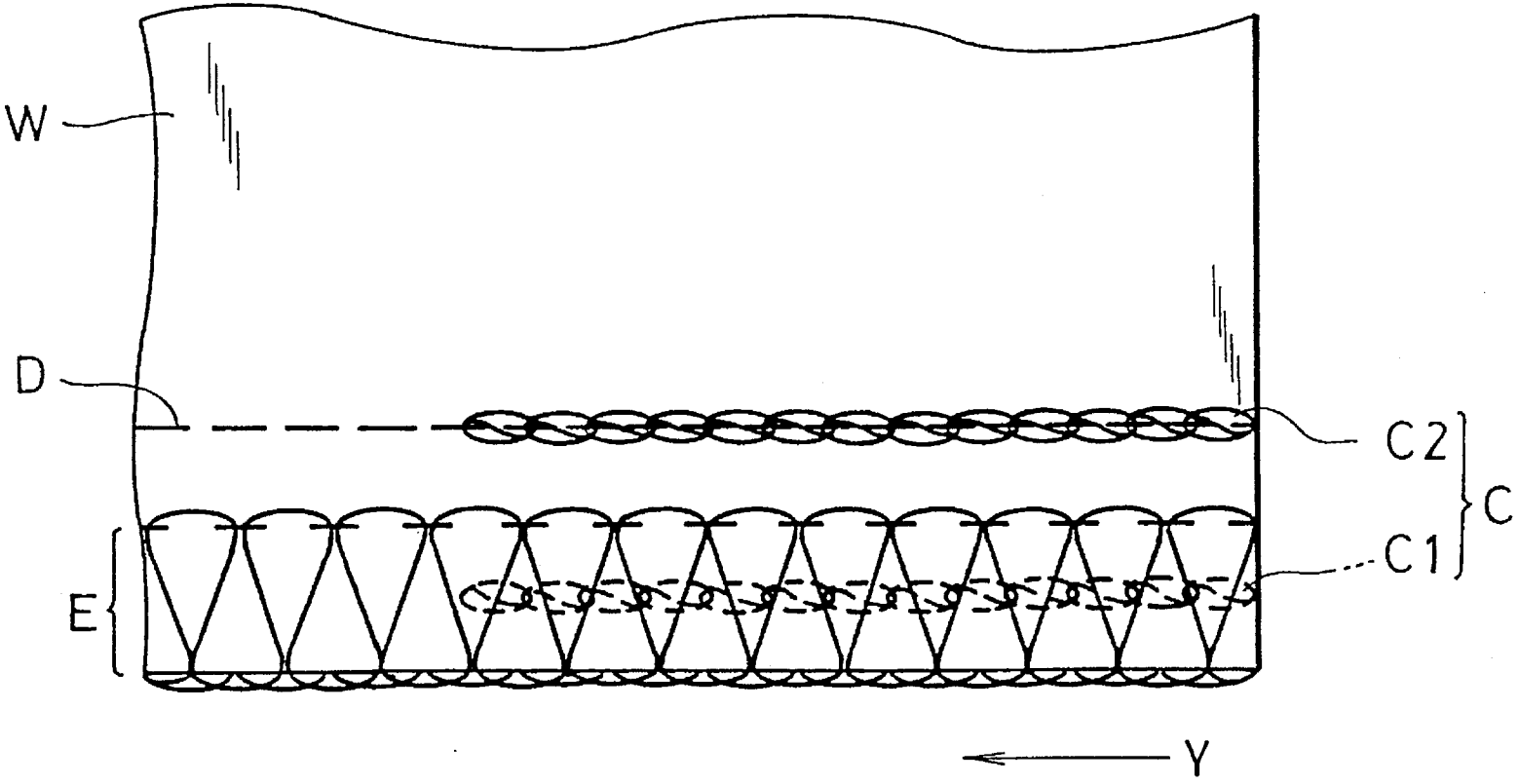
FIG. 8 is a plan view showing part of a fabric in which thread chains are sewn into initial ends of seams respectively according to the present invention.

Successively, a new fabric W' is put on the needle plate 9 beneath the presser foot 11, and the presser foot 11 is lowered to start the sewing machine 1, and pressure of the rocker arm 29 by the air cylinder 28 is released. Then the thread chain C2 held in the thread chain suction tube 23 slips out of the tube 23 and is guided along the sewing line L by the groove 22 formed on the lower surface of the presser foot 11 and is let out sequentially, and sewn into the double chain stitch D on the upper surface of the initial end of the new fabric W' as shown in FIG. 8, while the thread chain C1 for overedge seam in the tube 34 provided underneath the tongue 33 of the needle plate 9 is sewn into the overedge seam E at the lower side at the initial end of the fabric W'. Along with the operation of the sewing machine 1, when releasing the pressure of the rocker arm 29 by the air cylinder 28, a proper tension is given to the chain threads C1, C2 by the blowing action by the thin branch tubes 36, 36 of the Venturi tubes 37, 38, so that the thread chains C1, C2 are sewn in smoothly.

In the embodiment, the action of the spring 30 may change place with the air cylinder 28, or the thread chain may be held only by the air suction force without the thread chain gripping means 25.

Although the present invention described in the embodiment relates to a safety seam sewing machine for forming the double chain stitch seam and the overedge seam at the same time, the same effects are exhibited if the present invention is applied in a sewing machine for forming merely a double chain stitch or a single chain stitch alone.

What we claim is:

1. An apparatus for sewing a thread chain in a chain stitch sewing machine comprising a needle, a needle plate, a presser foot, and a feed dog, said apparatus comprising:

a rear cutter for cutting the thread chain behind said presser foot;

an air blow tube linked to a compressed air source, said air blow tube having an outlet directed forwardly; and a thread chain suction tube having thread chain holding means, said thread chain suction tube being provided above said presser foot, wherein:

the presser foot has an opening which penetrates the presser foot in a vertical direction in front of a needle hole, and a groove formed on a lower surface of the presser foot along a sewing line from the needle hole toward said opening; and said thread chain is cut by said rear cutter, and thereafter and with the presser foot being lifted above the needle plate, the next thread chain is shifted by blowing air from said outlet, and is held by said thread chain holding means in the thread chain suction tube through said groove and said opening, and is sewn into a seam formed on an initial end of a new fabric by a sewing action of the chain stitch sewing machine when the presser foot is put on the new fabric after the new fabric is supplied under the presser foot.

2. An apparatus for sewing a thread chain in a chain stitch sewing machine of claim 1, wherein said thread chain holding means includes a leaf spring and an air cylinder, and wherein said leaf spring is pressed to an inner wall of the thread chain suction tube by said air cylinder.

* * * * *